US006081107A

United States Patent [19]

Marino

[11] Patent Number: 6,081,107

[45] Date of Patent: Jun. 27, 2000

[54] CONTROL CIRCUIT FOR CONTROLLING A FLOATING WELL BIAS VOLTAGE IN A SEMICONDUCTOR INTEGRATED STRUCTURE

[75] Inventor: Filippo Marino, Palermo, Italy

[73] Assignee: STMicroelectronics S.r.l., Agrate Brianza, Italy

[21] Appl. No.: 09/270,895

[22] Filed: Mar. 15, 1999

[30] Foreign Application Priority Data

Mar. 16, 1998 [EP] European Pat. Off. ..... 98830144

[51] Int. Cl.[7] ..... G05F 1/56

[52] U.S. Cl. ..... 323/282

[58] Field of Search ..... 323/265, 266, 323/273, 282, 312, 313, 315

[56] References Cited

U.S. PATENT DOCUMENTS

| | | | |
|---|---|---|---|
| 5,093,770 | 3/1992 | Davenport | 363/74 |
| 5,825,236 | 10/1998 | Seevinck et al. | 327/538 |
| 5,864,226 | 1/1999 | Wang et al. | 323/273 |
| 5,903,141 | 5/1999 | Tailliet | 323/312 |

FOREIGN PATENT DOCUMENTS

| | | | |
|---|---|---|---|
| 2247837 | 4/1974 | Germany | G05F 1/44 |
| WO 9744721 | 11/1997 | WIPO | G05F 3/26 |

OTHER PUBLICATIONS

Awtrey D, "Voltage Converter Uses Digital Gate", *Electronic Design*, vol. 44, No. 15, Jul. 22, 1996, pp. 109/110, XP 000623872.

*Primary Examiner*—Matthew Nguyen
*Attorney, Agent, or Firm*—Theodore E. Galanthay; Robert Iannucci; Seed IP Law Group PLLC

[57] ABSTRACT

A control circuit comprises a plurality of input terminals and an output terminal for biasing a floating well in a semiconductor integrated circuit structure. The control circuit also includes a first transistor which has its conduction terminals connected between a first input terminal and an output terminal, and a second transistor which has its conduction terminals connected between a second input terminal and the output terminal. The control circuit further includes a regulator coupling the output terminal to each of the control terminals of said first and second transistors.

18 Claims, 3 Drawing Sheets

CONTROL CIRCUIT FOR CONTROLLING A FLOATING WELL BIAS VOLTAGE IN A SEMICONDUCTOR INTEGRATED STRUCTURE

FIELD OF THE INVENTION

This invention relates to a control circuit for controlling the bias voltage of a floating well in a semiconductor integrated circuit structure.

The invention relates, in particular but not exclusively, to a control circuit for controlling the bias voltage of a floating well, in order to form transistors for use in switching regulators, and the ensuing description will cover this specific field of application for convenience of illustration.

BACKGROUND OF THE INVENTION

As is known, there are many electrical applications wherein the value of a current flowing through an electric load needs to be regulated.

In most cases, the current through the electric load has been regulated by a power transistor which may either be of the integrated or the discrete types.

The power transistor, in turn, is driven by an integrated drive circuit commonly referred to as the high side driver.

This power transistor is usually a MOS transistor having gate, source, and drain terminals. To charge the gate terminal of this transistor, a second voltage supply, higher than that to be applied to the drain terminal, must be made available.

To produce this second voltage supply, a bootstrap capacitor is employed which can be re-charged during the conduction phase of a second power transistor, for example. This transistor is itself driven by means of an integrated drive circuit referred to as the low side driver.

However, the supply voltage to the bootstrap capacitor must be high, if the efficiency of switching circuits is to be enhanced. Thus, the MOS power transistor is driven with gate-source voltages selected to have the smallest possible switch-on resistance RDSon.

A possible construction of transistors using MOS technology is illustrated by FIG. 1.

An epitaxial well II of the N type is grown over a substrate I of the P type. Body regions III of the P type and IV of the N type are then formed to respectively provide N-channel and P-channel transistors.

For example, two regions of the N+ type are formed in the region BODY III of the P type to provide the source and drain regions of an N-channel transistor. The source region and the body region III are conventionally connected together by a common terminal HSRC.

By using a conventional process of manufacturing structures such as that shown in FIG. 1, e.g., with BCDIII technology, the operation of MOS transistors at relatively high working voltages can be ensured. In particular, for circuits employing voltage bootstrap structures, working voltages may be provided whose values equal the voltage drop across the bootstrap capacitor. However, as the bootstrap voltage is increased, a bias voltage of the epitaxial well II cannot be ensured to equal the working voltage, because the breakdown voltage of the junction created between this well II and the regions III of the P type is smaller than the voltage drop across the bootstrap capacitor.

SUMMARY OF THE INVENTION

An embodiment of this invention is directed to a control circuit for controlling the bias voltage of a floating well, which circuit has structural and functional features such that relatively high bias voltages can be used, and a breakdown of the junction created between the floating well and strongly biased regions effectively prevented, thereby overcoming the limitations and/or drawbacks with which prior art devices are beset.

The control circuit for the bias voltage of the floating well during operation of switching regulators such that the well voltage becomes variable proportionally to the voltages of contiguous regions, instead of being a fixed voltage.

The control circuit includes a plurality of input terminals; an output terminal for biasing a floating well in a semiconductor integrated circuit structure; a first transistor having its conduction terminals connected between a first input terminal and the output terminal, a second transistor having its conduction terminals connected between a second input terminal and the output terminal; and a regulator coupling the output terminal to each of the control terminals of the first and second transistors. In one embodiment, the regulator is a Zener diode.

The features and advantages of a device according to the invention will be apparent from the following description of an embodiment thereof, given by way of non-limitative example with reference to the accompanying drawings.

DETAILED DESCRIPTION

Figure 2:
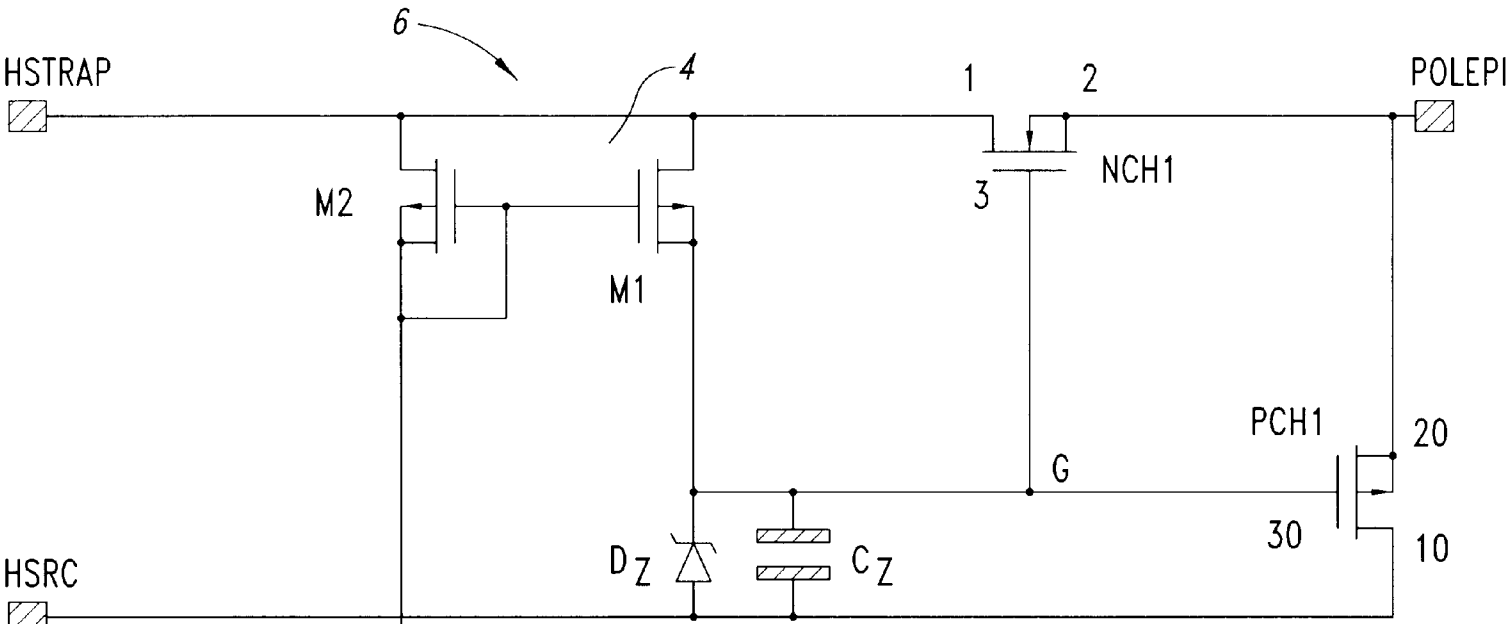
FIG. 2 shows a control circuit according to an embodiment of the invention.

Referring to the drawing figures, generally shown at 6 is a control circuit according to an embodiment of the invention.

The circuit 6 includes two input terminals HSTRAP and HSRC, and an output terminal POLEPI.

An N-channel first transistor NCH1 has a first conduction terminal 1 connected to the terminal HSTRAP, a second conduction terminal 2 connected to the terminal POLEPI, and a control terminal 3.

A P-channel second transistor PCH1 has a first conduction terminal 10 connected to the input terminal HSCR, a second conduction terminal 2 connected to the output terminal POLEPI, and a control terminal 30 connected to the control terminal 3 of the transistor NCH1 at a node G.

Advantageously, the body terminals of said transistors are connected to their respective second conduction terminals.

The control terminals 3, 30 of the two transistors NCH1, PCH1 are connected to a common node G. The terminal HSCR controls the voltage at the node G by means of a regulator Dz. This regulator may be a reverse biased Zener diode $D_Z$. However, the regulator could be obtained in an another way known to the skilled ones in the art.

Advantageously, a capacitor $C_Z$ is connected in parallel with the diode Dz.

The bias for the diode Dz may be provided by a first current mirror 4 connected between the terminal HSTRAP and the node G.

The mirror 4 comprises first M1 and second M2 mirror transistors which are both of the PMOS type in the example considered.

The first mirror transistor M1 has its respective source and drain conduction terminals connected to the terminal HSTRAP and the node G, and has a control terminal connected to the control terminal of the second mirror transistor M2, which is diode-connected and has its drain terminal connected to the ground GND through a second current mirror 5.

The second current mirror 5 comprises a pair of mirror transistors M3 and M4 of the NMOS type having their respective control terminals connected together. The transistor M3 is diode-connected.

The control terminal of the transistor M3 is connected by a capacitor C1 to ground.

As the skilled ones in art know well, the Zener diode Dz could also be biased in other ways.

Figure 3:
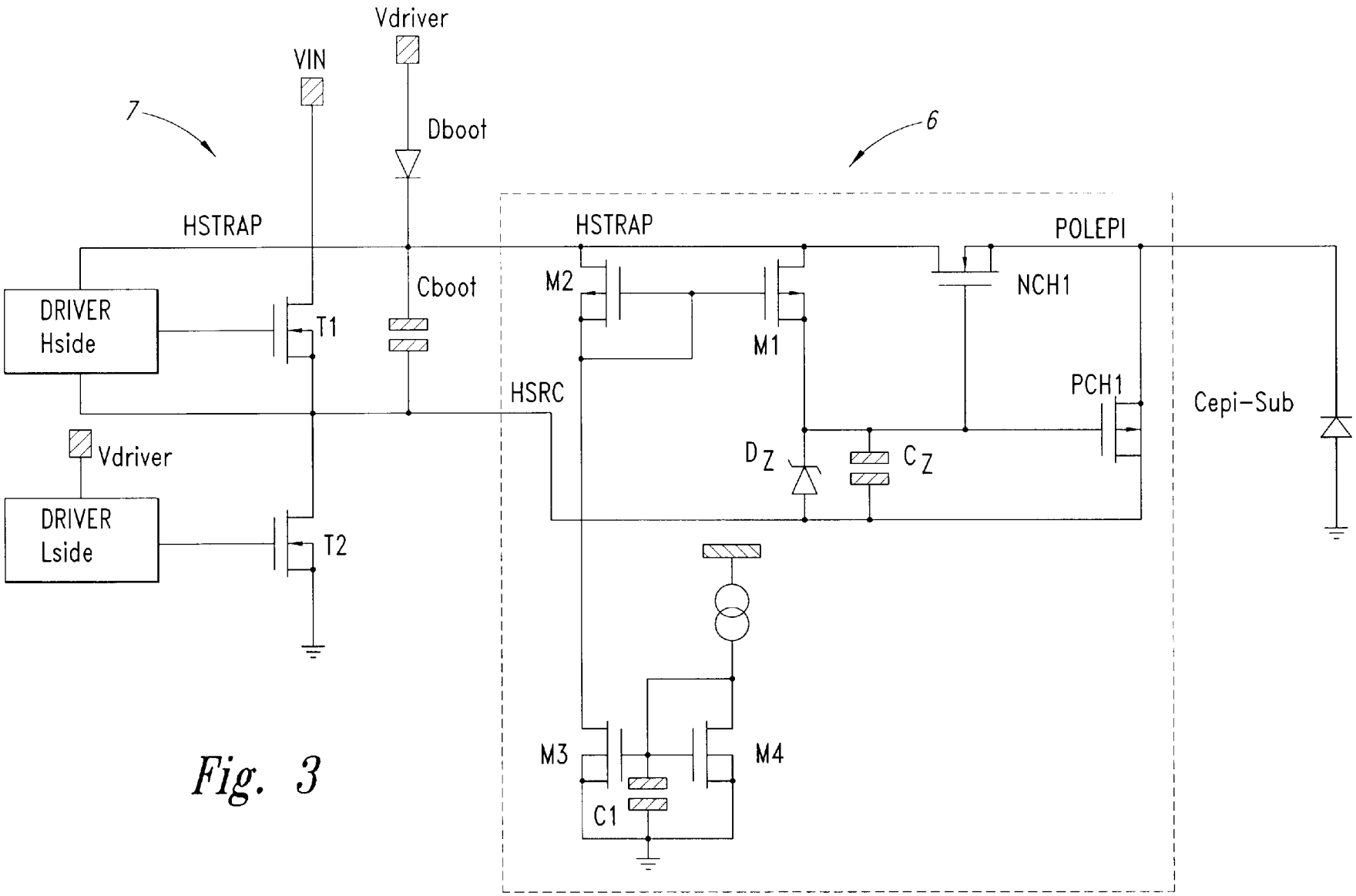
FIG. 3 illustrates an application of the control circuit shown in FIG. 2.

Shown in FIG. 3 is an integrated circuit 7 which includes an output stage of switching regulators with power transistors, and incorporates a conventional bootstrap capacitor. This capacitor could be external of the integrated circuit 7.

The control circuit 6 of FIG. 2 may be associated to advantage with the integrated circuit 7.

In this integrated circuit 7, a first power transistor T1 operates as a switch and has a first conduction terminal connected to a voltage Vin, and has a second conduction terminal connected to the node HSTRAP and to a ground reference through a second power transistor T2.

The control terminal of the first transistor T1 is connected to the output of a first drive circuit Driver Hside. The control terminal of the second transistor T2 is connected to the output of a second drive circuit Driver Lside.

A bootstrap capacitor Cboot is connected between the terminals HSTRAP and HSRC of the drive circuit Driver Hside, and is powered from a voltage generator Vdriver having a diode Dboot in series therewith.

The control circuit 6 of FIG. 2 is connected to the terminals HSTRAP and HSRC.

Figure 1:
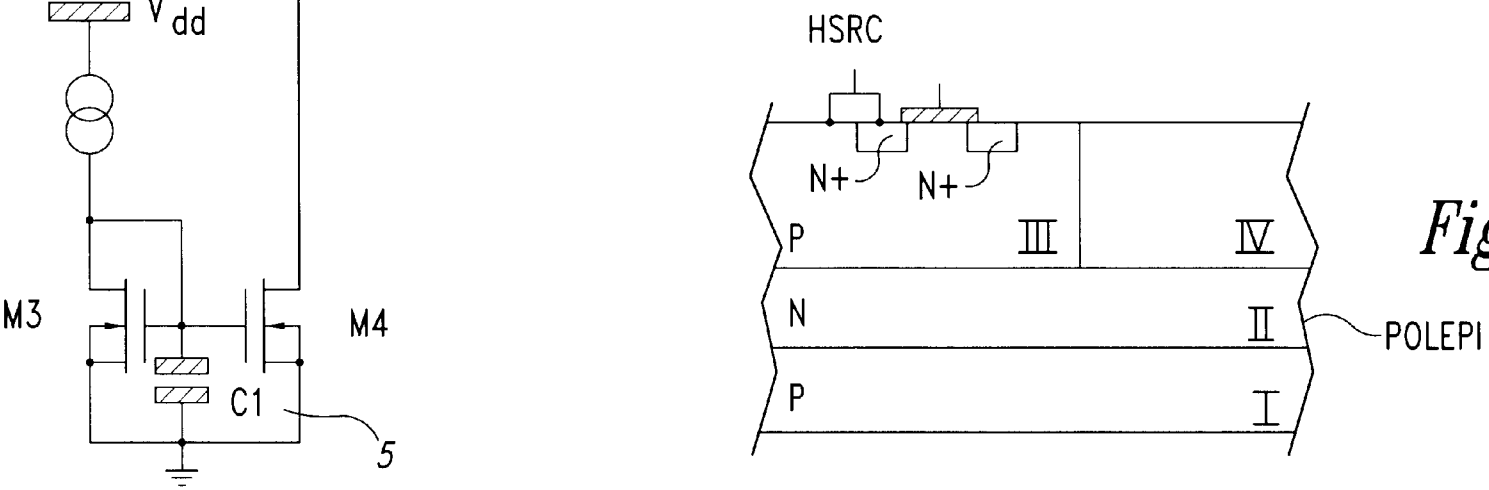
FIG. 1 shows a portion of a semiconductor device formed with a floating epitaxial well.

FIG. 1 shows a portion of a semiconductor device wherein the input terminal HSCR is connected to the body region III of the P type, and the output terminal POLEPI is connected to the epitaxial well II.

A diode Cepi-sub represents the junction between an epitaxial well II and the substrate I where the integrated circuit is formed.

The operation of the control circuit of FIG. 2 will now be described.

With the transistor T1 in the off state and the transistor T2 in the on state, the bootstrap capacitor Cboot is charged, and the terminal HSTRAP is at the drive voltage of the drivers, so that:

$$V_{HSTRAP}=\text{Vdriver}-\text{Vbe}$$

where, Vbe is the voltage drop across the diode Dboot. The voltage $V_{HSRC}$ at the terminal HSRC is substantially equal to zero (negligible voltage drop across transistor T2.

When the transistor T1 is turned on, and the transistor T2 turned off, the terminal HSRC goes to a voltage value $V_{HSRC}=\text{Vin}$, and the terminal HSTRAP to a voltage value given as $V_{HSTRAP}=\text{Vin}+\text{Vdriver}-\text{Vbe}$.

This rising edge of the signal Vin applied to the terminal HSRC is sensed by the Zener diode Dz, which will cause the transistor NCH1 to conduct. The terminal POLEPI will then attain a voltage value given as:

$$V_{EPI}=V_{zener}-V_{gs(NCH1)}+V_{HSRC}.$$

Advantageously, the capacitor Cz provided holds the voltage constant across the Zener diode Dz.

When the transistor T1 is turned off, and the transistor T2 turned on, the terminals HSRC and HSTRAP attain respectively $V_{HSRC}=0$ and $V_{HSTRAP}=\text{Vdriver}-\text{Vbe}$. In this condition, the transistor NCH1 is turned off and the transistor PCH1 turned on. Thus, the voltage at the terminal POLEPI is controlled to a value given by:

$$V_{EPI}=V_{zener}-V_{gs(PCH1)}.$$

Figure 4A:
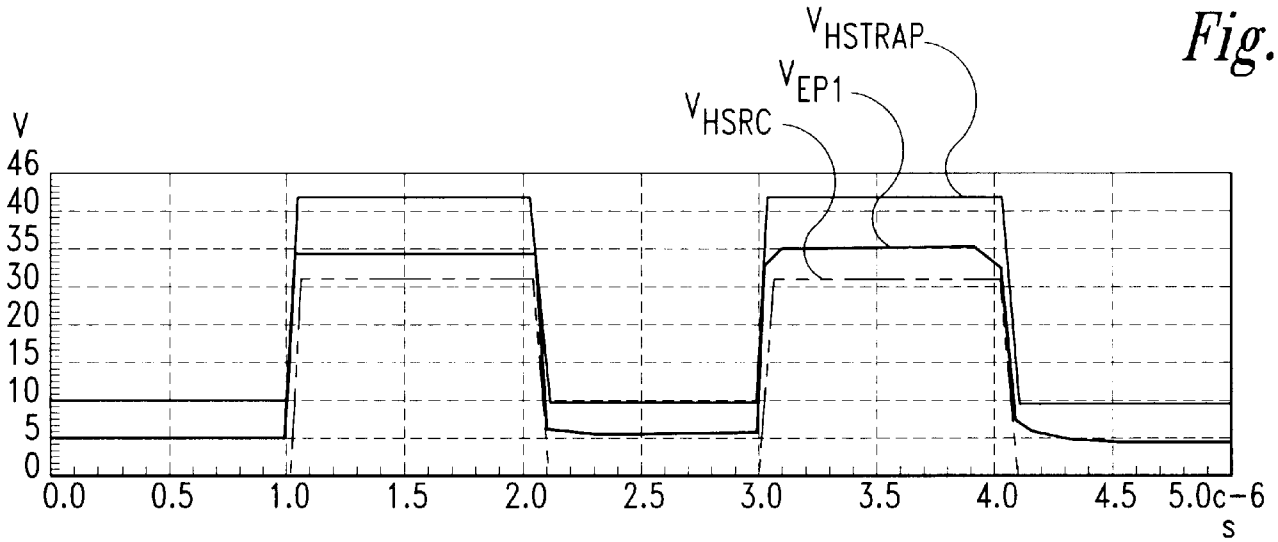
FIGS. 4*a*, 4*b* are plots of voltage signals in the control circuit of FIG. 2.

Shown schematically in FIG. 4*a* is a voltage vs. time plot of the voltages $V_{HSTRAP}$, $V_{HSRC}$, and $V_{EPI}$, on a common time base.

This first plot brings out the fact that the voltage $V_{EPI}$ follows the patterns of the voltages $V_{HSTRAP}$, $V_{HSRC}$.

Figure 4B:
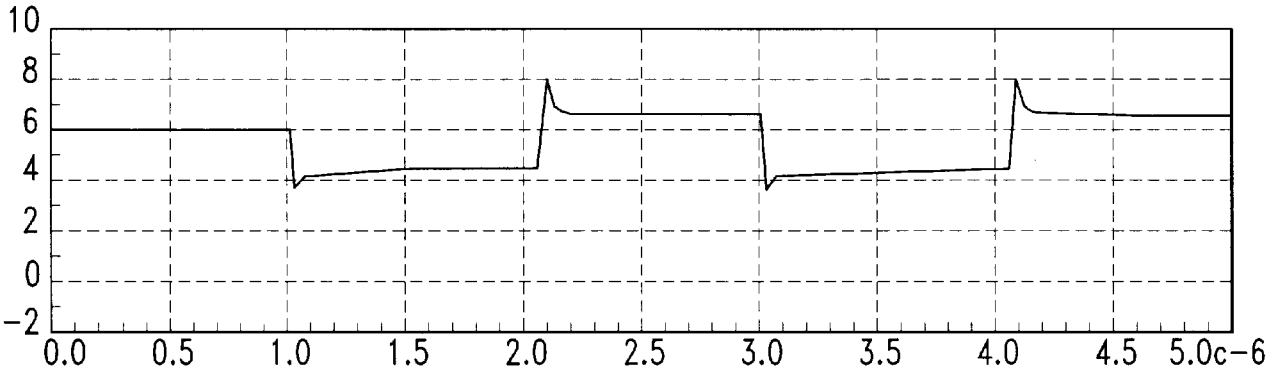

FIG. 4*b* shows a plot illustrating the difference between the epitaxial well voltage ($V_{EPI}$) and that of the BODY regions ($V_{BODY}$) where the N-channel transistors of the integrated circuit 7, the drive circuit Driver Hside, and the circuit 6 of FIG. 2, and the transistor T1 are all formed.

The use of the control circuit 6 ensures that the voltage across the epitaxial well and the BODY regions will not exceed the breakdown voltage of the resulting junction.

To summarise, the control circuit 6 affords control of the bias voltage of a floating well as an input voltage varies.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A control circuit comprising a plurality of input terminals; an output terminal for biasing a floating well in a semiconductor integrated circuit structure; a first transistor having a control terminal and conduction terminals, the conduction terminals being connected between a first input terminal and the output terminal, a second transistor having a control terminal and conduction terminals, the conduction terminals of the second transistor being connected between a second input terminal and the output terminal; a zener diode coupling the output terminal to each of the control terminals of said first and second transistors; and a current mirror coupled to said Zener diode in a manner that biases the Zener diode.

2. A control circuit according to claim 1, further comprising a capacitor connected in parallel with said Zener diode.

3. A control circuit according to claim 1, wherein said first transistor is a MOS transistor of the N-channel type.

4. A control circuit according to claim 1, wherein said second transistor is a MOS transistor of the P-channel type.

5. A control circuit according to claim 1, wherein said Zener diode is reverse biased to the control terminals of said first and second transistors.

6. A control circuit for controlling a bias voltage of a floating well of an integrated semiconductor circuit, the control circuit comprising:

first and second input terminals;

an output terminal for biasing the floating well;

a first transistor having a control terminal and conduction terminals, the conduction terminals being connected between the first input terminal and the output terminal, the first transistor being of a first conduction type that conducts current across its conduction terminals when its control terminal is at a first logic level;

a second transistor having a control terminal and conduction terminals, the conduction terminals of the second transistor being connected between the second input terminal and the output terminal and the control terminal of the second transistor being connected to the control terminal of the first transistor, the second transistor being of a second conduction type that conducts current across its conduction terminals when its control terminal is at a second logic level opposite to the first logic level; and a regulator coupling the second input terminal to the control terminals of the first and second transistors.

7. The control circuit of claim 6 wherein the regulator is a Zener diode.

8. The control circuit of claim 7 wherein the Zener diode is reverse biased to the control terminals of the first and second transistors.

9. A control circuit for controlling a bias voltage of a floating well of an integrated semiconductor circuit, the control circuit comprising:

first and second input terminals;

an output terminal for biasing the floating well;

a first transistor having a control terminal and conduction terminals, the conduction terminals being connected between the first input terminal and the output terminal;

a second transistor having a control terminal and conduction terminals, the conduction terminals of the second transistor being connected between the second input terminal and the output terminal;

a zener diode coupling the second input terminal to the control terminals of the first and second transistors; and a current mirror having first and second mirror transistors, the first mirror transistor having conduction terminals coupled between the first input terminal and the Zener diode and the second mirror transistor having conduction terminals coupled between a current source and the first input terminal.

10. The control circuit of claim 7, further comprising a capacitor connected in parallel with the Zener diode.

11. The control circuit of claim 6 wherein the first transistor is an N-channel MOS transistor.

12. The control circuit of claim 11 wherein the second transistor is a P-channel MOS transistor.

13. The control circuit of claim 6 wherein the control circuit is an integrated circuit formed on a semiconductor substrate on which an epitaxial well has been grown and a body layer is formed on the epitaxial layer, wherein the output terminal is coupled to the epitaxial layer and the second input is coupled to the body layer.

14. The control circuit of claim 13, further comprising a bootstrap capacitor coupled between the first and second input terminals.

15. The control circuit of claim 14, further comprising:

a high-side drive transistor controlled by a high-side driver and having first and second conduction terminals coupled between a first reference voltage and the second input terminal; and a low-side drive transistor controlled by a low-side driver and having first and second conduction terminals coupled between the second input terminal and a second reference voltage.

16. A method of controlling a bias voltage of a floating well of an integrated semiconductor circuit, the method comprising:

during a first phase, driving the floating well with a control signal equal to a regulated voltage minus a threshold voltage of a first transistor coupled between the floating well and a first input; and during a second phase, driving the floating well with the control signal equal to the regulated voltage plus an input voltage at the first input minus a threshold voltage of a second transistor coupled between the floating well and a second input.

17. The method of claim 16 wherein the regulated voltage is a voltage across a zener diode coupled between the first input and a control terminal of each of the first and second transistors.

18. The method of claim 16 wherein the first input is coupled to a body layer formed on the floating well.

* * * * *